United States Patent [19]

Duncan et al.

[11] Patent Number: 4,549,634

[45] Date of Patent: Oct. 29, 1985

[54] SCAFFOLD CONNECTOR ASSEMBLY

[75] Inventors: Charles W. Duncan, Houston, Tex.; David G. Murray, Cleveland, Ohio

[73] Assignee: Waco International Corporation, Houston, Tex.

[21] Appl. No.: 485,307

[22] Filed: Apr. 15, 1983

[51] Int. Cl.[4] ..... E04G 7/30

[52] U.S. Cl. ..... 182/179; 182/178; 403/49; 403/46

[58] Field of Search ..... 182/179, 178; 403/49, 403/46; 52/638, 637

[56] References Cited

U.S. PATENT DOCUMENTS

| | | | |
|---|---|---|---|
| 3,420,557 | 1/1969 | Francis et al. | 287/54 |
| 4,005,548 | 2/1977 | Nahon | 182/179 |
| 4,348,128 | 9/1982 | Gostling | 403/49 |
| 4,369,859 | 1/1983 | Smits | 182/179 |

FOREIGN PATENT DOCUMENTS

| | | | |
|---|---|---|---|
| 7508700 | 1/1976 | Netherlands | 187/178 |

*Primary Examiner*—Reinaldo P. Machado
*Assistant Examiner*—Alvin Chin-Shue
*Attorney, Agent, or Firm*—Pravel, Gambrell, Hewitt & Kimball

[57] ABSTRACT

A scaffold connector assembly for connecting upright members to cross members to form a scaffolding structure. The scaffold connector assembly is adapted to connect upright members with cross members so as to form both orthorhombic and monoclinic substructures. The scaffold connector assembly is further adapted to interconnect both the orthorhombic and monoclinic substructures so as to form closed polygon scaffolding structures.

8 Claims, 4 Drawing Figures

A
12
W
H
T'
2
P
30
L
22
C'
24a
22b
22c
20b
20a'
22a
22a'
14b
16
10
20a
20c
S
18
24
C
C"
14a
14c
24d
24b
24c
T
V
20
11
24e

SCAFFOLD CONNECTOR ASSEMBLY

FIELD OF THE INVENTION

The present invention relates generally to the field of connector assemblies.

DESCRIPTION OF THE PRIOR ART

It is known to connect upright and cross members together to form scaffolding structures. U.S. Pat. No. 3,420,557 discloses a wedged clamping mortise and tenon assembly for connecting upright and cross members to form a substantially orthorhombic scaffolding structure. The scaffolding structure thus formed is substantially orthorhombic in that the lengths of the upright and cross members need not be equal but the connector assembly is limited to substantially orthogonal connections of the cross members with the upright member.

SUMMARY OF THE INVENTION

The present invention provides a new and improved scaffold connector assembly for connecting upright members to cross members to form a scaffold structure. The scaffold connector assembly includes a socket securely mounted with the upright member. The socket has an elongated opening substantially parallel to the upright member. The connector assembly also includes a connector having a yoke mounted with a cross member. The yoke has first and second yoke arms a spaced distance apart to receive the socket. The first yoke arm has a wedge-receiving slot while the second yoke arm has a wedge-receiving hole in alignment with the slot of the first support arm. In the operative position, the slot, the hole and the elongated opening are in alignment for receiving a locking wedge.

The inner ends of one or both of the first and second yoke arms includes arcuate abutment surfaces, each of which is adapted to be wedged into a position to resistively engage the upright member so as to align the yoke and cross member at acute angles to an imaginary perpendicular to the upright member thus forming a monoclinic substructure. Each of the first and second yoke arms also has a linear or flat abutment surface between the arcuate abutment surfaces which is adapted to resistively engage the upright member so as to align the yoke to the socket perpendicularly to the upright member thus forming an orthorhombic substructure.

The connector assembly also includes a tapered wedge which is mounted for locking engagement with the walls of the upper slot, the lower hole and the elongated opening so as to securely fasten the connector to the socket for retaining the desired alignment to form a scaffolding structure. Through the use of a plurality of scaffolding connector assembles so as to interconnect monoclinic and orthorhombic substructures together, a closed polygon scaffolding structure can be formed to provide an endless working platform around the circumference of tanks, vessels and other structures.

BRIEF DESCRIPTIONS OF THE DRAWINGS

BRIEF DESCRIPTION OF THE PREFERRED EMBODIMENT

Figures 1, 2, 3, 4:
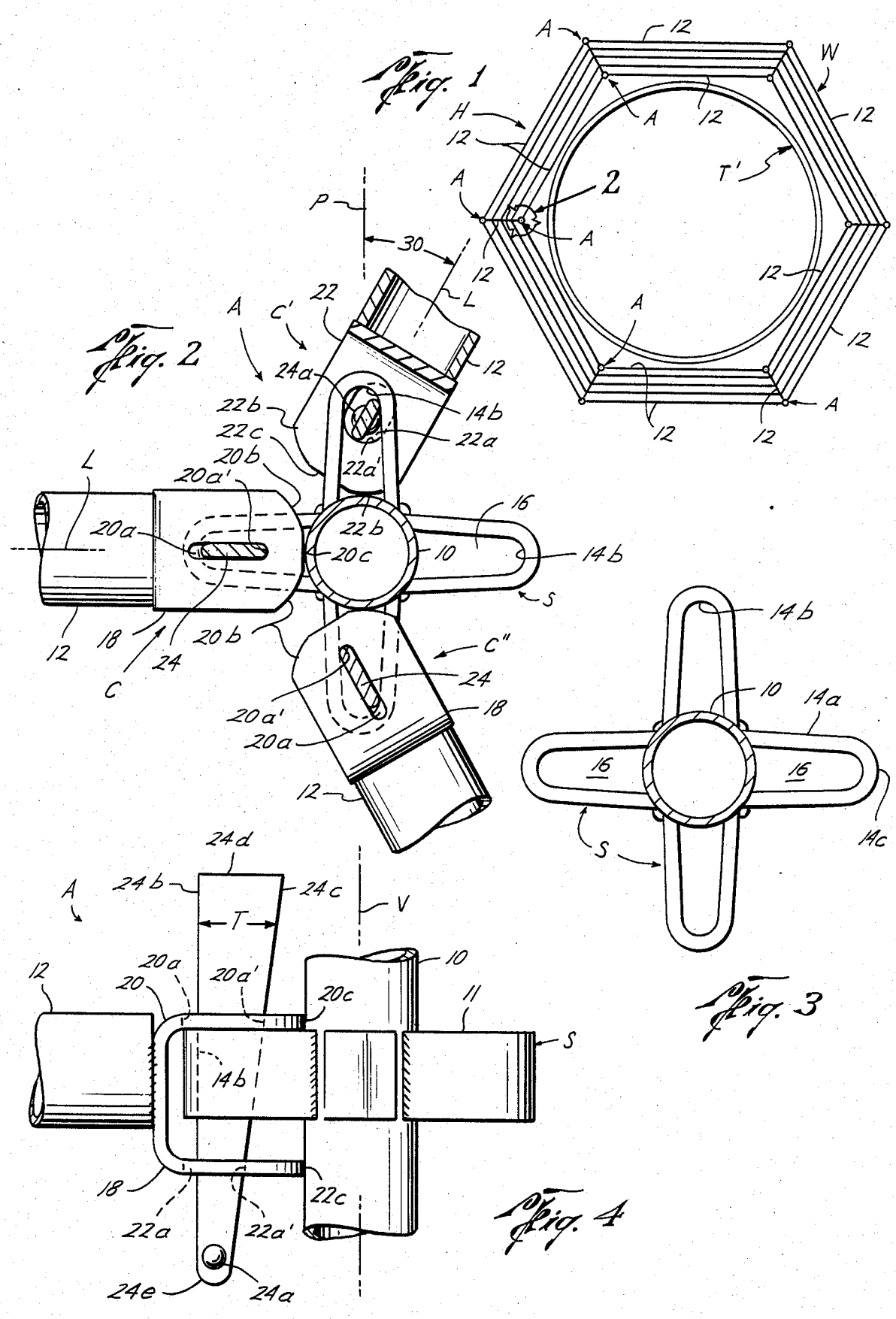
FIG. 1 is a schematic plan view of the connector assemblies forming a closed polygon scaffold structure about the circumference of a tank.
FIG. 2 is a plan view partially fragmented, of the connector assembly of FIG. 1.
FIG. 3 is a plan view of the portion of the connector assembly on the upright member, showing the four sockets affixed to the upright member at one elevation.
FIG. 4 is an elevational view of one connector assembly.

The scaffold connector assembly of the present invention is generally designated by the letter A. Scaffold connector assembly A in the present invention is adapted to connect upright members 10 with cross members 12 to form a scaffolding structure H as shown in FIG. 1.

Each connector assembly A includes a plurality of sockets S, usually four, securely mounted with upright member 10 by welding or the like and extending laterally therefrom. Each socket S is formed by bending a rectangular plate 14*a* into a substantially U-shape having an inner surface 14*b*. The inner surface 14*b* is disposed inwardly of a radiused apex or curved outer surface 14*c*. Each socket S has an elongated opening 16 which is generally parallel to the longitudinal axis V of upright member 10.

The connector assembly A of the present invention further includes a connector C which includes a yoke 18 securely mounted with the cross member 12 by welding or other suitable means. The yoke 18 has a first or upper yoke arm 20 and a second or lower yoke arm 22 which are spaced a sufficient distance apart to receive a socket S. The first yoke arm 20 has a wedge-receiving slot 20*a* while the second yoke arm 22 has a wedge-receiving hole 22*a* in alignment with the slot 20*a*. In operative connection, the slot 20*a*, the hole 22*a* and the elongated opening 16 are in locking alignment as best seen in FIG. 4.

Each of the first and second yoke arms 20, 22 has a linear abutment surface 20*c*, 22*c* respectively, adapted to resistively engage the upright member 10 so as to align the yoke 18 to the socket S such that the cross member 12 is orthogonal, i.e. a right angle (see FIG. 2 and 4) to the longitudinal axis V of upright member 10 so as to form an orthorhombic substructure R such as illustrated in FIG. 2.

Further, each of the first and second yoke arms 20, 22 preferably has arcuate abutment surfaces 20*b*, 22*b*, respectively, and linear abutment surfaces 20*c*, 22*c*, respectively. Each arcuate surface 20*b*, 22*b* is adapted to resistively engage upright member 10 so as to align the yoke 18 to the socket S at an acute angle such as indicated at 30 in FIG. 2. As explained more fully hereinafter, each connector C may be moved when the wedge 24 is in the raised non-locking position, so as to be either in a perpendicular position (left connector C in FIG. 2), or at an acute angle (top connector C′ in FIG. 2) or at an opposite acute angle (bottom connector C″ in FIG. 2). Acute angle 30 illustrated for the top connector C′ in FIG. 2 is included between the longitudinal axis L of cross member 12 and an imaginary perpendicular P drawn to the longitudinal axis V of upright member 10. Preferably, the acute angle 30 includes angles up to about 30° from either side of perpendicular P. With the yoke 18 and connected cross member 12 angularly mounted with the socket S, a monoclinic substructure is formed.

The monoclinic substructure is understood by those skilled in the art to include substructures wherein a plurality of cross members 12 are connected to an upright member 10 by connector assembly A so as to form a substructure in which the upright member 10 is substantially perpendicular to the cross members 12 and the cross members 12 are angularly disposed one from the other by an angle other than 90°.

A tapered wedge 24 is inserted in locking engagement with walls of the slot 20*a*, the hole 22*a* and the opening 16 to securely fasten the yoke 18 with the socket S to secure the desired scaffolding structure. Tapered wedge 24 includes a button 24*a* mounted at a lower end 24*e* thereof which is a size together with the width of the wedge itself to prevent the passage of the button 24*a* through the slot 20*a*, so as to prevent withdrawal of the wedge 24 from the yoke 18. However, the button 24*a* can pass through the opening 22*a* to get the wedge 24 high enough in the socket S so that upon lifting the yoke 18, it and the wedge 24 can be separated from the socket S. For that reason, the lower yoke arm 22 is spaced below the lower edge of the socket S far enough to accomplish such removal of the yoke 18 and wedge 24 from the socket S. In some instances, the button 24*a* may be omitted and be completely removable from the yoke 18 and socket S.

The tapered wedge 24 includes a generally linear locking edge 24*b* and an inclined or tapered locking edge 24*c*. The linear locking edge 24*b* is a spaced distance T from tapered locking edge 24*c*; however, such spaced distance T decreases from the upper end of locking wedge 24*d* to its lower end 24*e*. The maximum width of the upper end 24*d* is greater than the length of slot 20*a*. Tapered wedge 24 is adapted to freely engage and disengage the walls of the holes 22*a* to permit inserting socket S between the first yoke arm 20 and the second yoke arm 22.

With the yoke 18 mounted at an angle up to 30° to either side of perpendicular P, a predetermined clearance is provided between a locking surface 20*a*′ of slot 20*a* and inner surface 14*b*. Similarly, with the yoke 18 so disposed relative to the socket S, the locking surface 22*a*′ of hole 22*a* is a predetermined distance from the surface 14*b*. As will be more fully explained, those clearances and the taper of the wedge 24 are correlated so that the wedge engages those surfaces described above in the locked position, but when the wedge 24 is moved upwardly relative to the yoke 18 to a non-locking position, there is clearance between the wedge 24 and such surfaces 20*a*′, 14*b* and 22*a*′, 14*b*, respectively, to permit pivotal or swinging movement of the yoke 18 relative to the member 10 to one of the three positions shown in FIG. 2.

As the tapered wedge 24 is driven or forced into the slot 20*a*, opening 16 and hole 22*a*, the linear edge 24*b* comes into resistive locking engagement with inner surface 14*b* and the tapered edge 24*c* comes into resistive locking engagement with locking surface 20*a*′ of slot 20*a* and locking surface 22*a*′ of hole 22*a* at the points where the width of tapered elongated wedge 24 corresponds to their predetermined clearances. At the time the wedge 24 is so engaged, either the arcuate surfaces 20*b* and 22*b* or the flat surfaces 20*c* and 22*c* engage the external surface of the upright member 10 so that the connector is in one of the three selected positions shown in FIG. 2, and it cannot move out of the selected locked position. The cross member 12 may thus be securely positioned at angles of up to 30° relative to the perpendicular P when the surfaces 20*b*, 22*b* engage the upright 10 to form monoclinic substructure M.

With yoke 18 and attached cross member 12 positioned such that the longitudinal axis L of the cross member 12 is substantially perpendicular to the longitudinal axis V of upright member 10 such that linear surfaces 20*c*, 22*c* resistively engage the upright member 10, both yoke 18 and cross member 12 are locked perpendicular to upright member 10 in a transverse plane thereto.

As the tapered wedge 24 is driven into locking engagement with engagement surface 22*a*′, 20*a*′ and surface 14*b*, connector C cannot move out of locking engagement with the external surface of upright member 10. As such, cross member 12 and upright member 10 are orthogonally mounted to form orthorhombic substructure R.

It can be seen that as the connector C is rotated from the perpendicular position, i.e. orthorhombic substructure, to the angular position up to 30° to either side of the perpendicular P, i.e. monoclinic substructure, that the spaced distance between locking surface 20*a*′ and inner surface 14*b* as well as between locking surface 22*a*′ and surface 14*b* decreases. Since tapered wedge 24 is tapered along its length between edges 24*b* and 24*c* all of these spaced clearances as well as clearances intermediate thereto are provided along the length of tapered wedge 24.

Method of Use

In operation, it is oftentimes desirable to erect a continuous scaffolding structure H about the circumference of a large tank T and other similar structures in order to provide a continuous working platform thereabout. It is for that use that the connector assembly A of the present invention is particularly adapted. In order to erect such a scaffolding structure H, a plurality of upright members 10, having sockets S equispaced about the circumference and at each end thereof, are connected to cross members 12 having yokes 18 at each end thereof with tapered wedges 24. Four sockets S are preferably mounted at each end of upright member 10 as shown in FIG. 3.

Upright members 10 are vertically positioned adjacent the tank T and connectors C including cross members 12 having yokes 18 mounted at either end thereof are positioned in operative alignment with each socket S such that slot 20*a*, hole 22*a* and opening 16 are in alignment for locking. Thereafter, connector C may be rotated in a plane generally perpendicular to the longitudinal axis V of cross member 10 up to an angle 30° to either side of perpendicular P such that either curved surfaces 20*b*, 22*b* or flat surfaces 20*c*, 22*c* resistively engage the upright member 10. With the yoke 18 aligned in the selected position, tapered wedge 24 is driven into locking engagement with the walls of the slot 20*a*, hole 22*a* and surface 14*b* to lock the cross member 12 to upright member 10.

As seen in FIGS. 1 and 2, by progressively interconnecting orthorhombic and monoclinic substructures with the connector assembly A of the present invention, a closed scaffolding structure H may be erected about the periphery of a tank T so as to form a continuous working platform thereabout.

Since the maximum angular displacement of the yoke 18 and cross member 12 from the perpendicular P to the vertical upright member 10 is 30°, the least number of the polygon sides of the scaffolding structure which can be formed using the invention is a hexagonal scaffolding structure H shown in FIG. 1. Since the cross members 12 can be angularly positioned at any angle up to and including 30°, polygons having an even number of sides of greater than six can be formed therefrom to form a continuous working platform.

The parallel cross members 12 in FIG. 1 extending at an acute angle from the upright member 10 are tied together at connector assembly A by the shorter cross members 12 which are substantially orthogonal to the upright member 10. Planks W are laid on the shorter cross members 12 to form the continuous working platform.

It is understood by those skilled in the art that upright members 10 and cross members 12 can be manufactured in various lengths. Although closed rectangular scaffolding structure could be formed using entirely orthorhombic substructures R about tank T, polygons having six sides or more are preferred since they more closely approximate the contour of the tank T and thereby enable the scaffold structure H to be placed as close as possible to the external surface of the tank T.

The foregoing disclosure and description of the invention are illustrative and explanatory thereof, and various changes in the size, shape and materials, as well as in the details of the illustrated construction may be made without departing from the spirit of the invention.

We claim:

1. A scaffold connector assembly for connecting upright member to a cross member to form a scaffolding structure comprising:

a socket mounted with the upright member, said socket having an elongated opening substantially parallel to the axis of the upright member adapted for locking engagement;

a connector having an opening adapted to mount with said socket;

said connector includes a yoke mounted with the cross member;

a wedge adapted to be mounted in said connector opening and positioned in said socket for locking said connector in selected positions relative to said socket and upright member; and said yoke having a first abutment surface adapted to resistively engage the upright member so as to securely and selectively lock said connector to said socket in a position perpendicular to the upright member and a second abutment surface adapted to resistively engage the upright member so as to securely and selectively lock said connector to said socket at an angle up to about 30° from the position perpendicular to the upright member when said wedge is mounted in said connector opening and said socket.

2. The scaffold connector assembly of claim 1 wherein:

said first abutment surface comprises a flat portion on said yoke adapted to resistively engage the upright member so as to securely position said connector to said socket for the perpendicular alignment of the connector to the upright.

3. The scaffold connector assembly of claim 1, wherein said yoke includes:

first and second yoke arms disposed a spaced distance apart to receive said socket;

said first yoke arm having a slot; and said second yoke arm having an opening in locking alignment with said slot.

4. The scaffold connector assembly of claim 3, wherein:

each of said first and second yoke arms includes first and second abutment surfaces adapted to selectively engage the upright member so as to align and lock said yoke to said socket either perpendicularly or at an angle of at up to about 30° from perpendicular to form a closed polygon scaffold structure.

5. The scaffolding connector assembly of claim 4, wherein:

said closed polygon scaffold structure is an even sided polygon; and said closed polygon scaffold structure is at least a hexagon.

6. In a scaffolding structure comprising cross members and upright members having equispaced sockets laterally extending from the upright member for interlocking with the cross members the improvement comprising:

a connector attached to each end of the cross members having first abutment surface adapted to resistively engage the upright in a position perpendicular to the upright and a second arcuate abutment surface adapted to resistively engage the upright member at an angle of up to about 30° from a position wherein the connector is perpendicular to the upright; and means including a tapered wedge extending through the aligned connector and socket for locking the connector to the upright at said angle.

7. The scaffolding structure improvement of claim 6, wherein:

said first abutment surface comprises a substantially flat abutment surface adapted to resistively engage the upright member to lock the connection in a position perpendicular to the upright; and said first abutment surface or said second abutment surface can be selectively engaged with the upright member by positioning the connector relative to the upright in the desired position and then inserting the tapered wedge through the aligned connector and socket.

8. A method for assembling a closed polygon scaffolding structure about a structure from upright members, and cross members, each upright member having equispaced sockets extending laterally therefrom, a connector mounted at each end of the cross members having a first substantially flat and a second arcuate abutment surface the method comprising the progressive steps of:

placing the upright member at a desired location adjacent the structure;

selectively abutting either the first or second abutment surface of the connector with the upright member;

aligning the connector with the upright member in a position perpendicular to the upright member when the first surface is in engagement with the upright member;

aligning the connector with the upright member at an angle up to about 30° from a position perpendicular the upright member when the second arcuate surface of the connector is in contact with the upright member;

inserting a tapered wedge into the aligned connector and socket to fix the angular orientation of the cross member with the upright member; and progressively connecting additional connectors to the sockets in a predetermined sequence until a scaffolding structure of the desired shape is completed.

* * * * *